United States Patent [19]

Bondi

[11] 4,185,860

[45] Jan. 29, 1980

[54] PADLOCK AND BOLT ASSEMBLY

[75] Inventor: Herman H. Bondi, Portland, Oreg.

[73] Assignee: Skylawn, Hayward, Calif.

[21] Appl. No.: 870,271

[22] Filed: Jan. 18, 1978

[51] Int. Cl.[2] ..... E05C 1/04
[52] U.S. Cl. ..... 292/148; 70/129
[58] Field of Search ..... 70/129, 134; 292/148, 292/205, 104

[56] References Cited

U.S. PATENT DOCUMENTS

| | | | |
|---|---|---|---|
| 3,334,933 | 8/1967 | Ehlers | 292/148 |
| 3,655,229 | 4/1972 | Tumbiolo | 292/148 |
| 4,125,281 | 11/1978 | Dean et al. | 70/129 |

*Primary Examiner*—Kenneth Dorner
*Attorney, Agent, or Firm*—Chernoff & Vilhauer

[57] ABSTRACT

A padlock and bolt assembly wherein the bolt is capable of complete disengagement from bolt receiving means only upon normal operation of the padlock with a key or upon severance of both legs of the link of the padlock.

4 Claims, 9 Drawing Figures

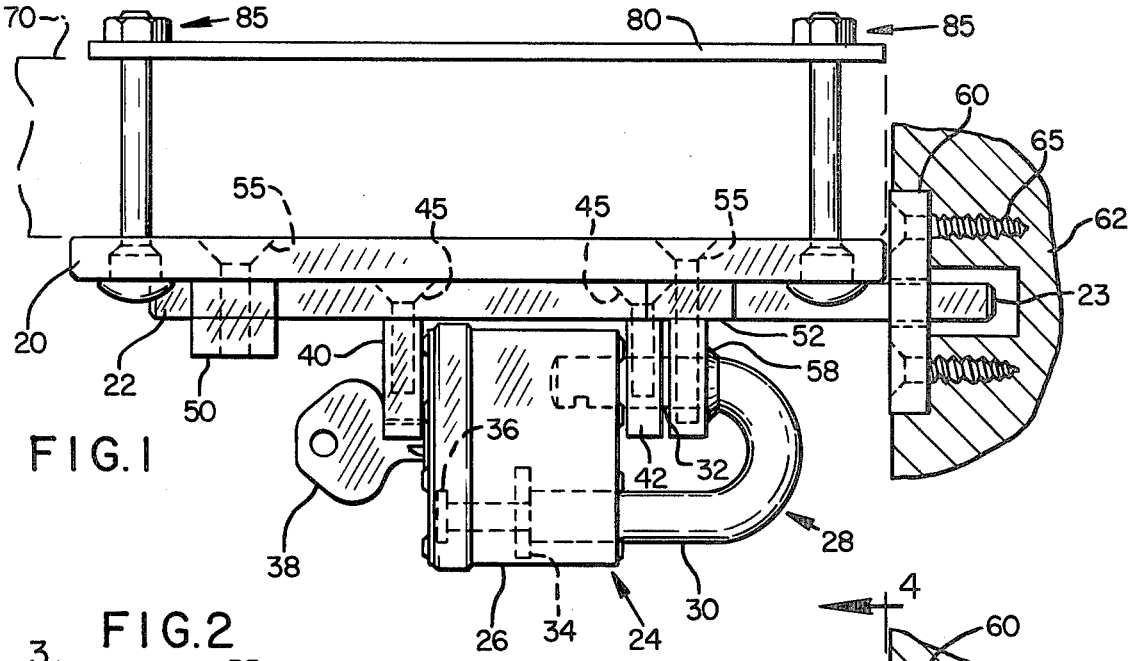
FIG. 1
FIG. 2
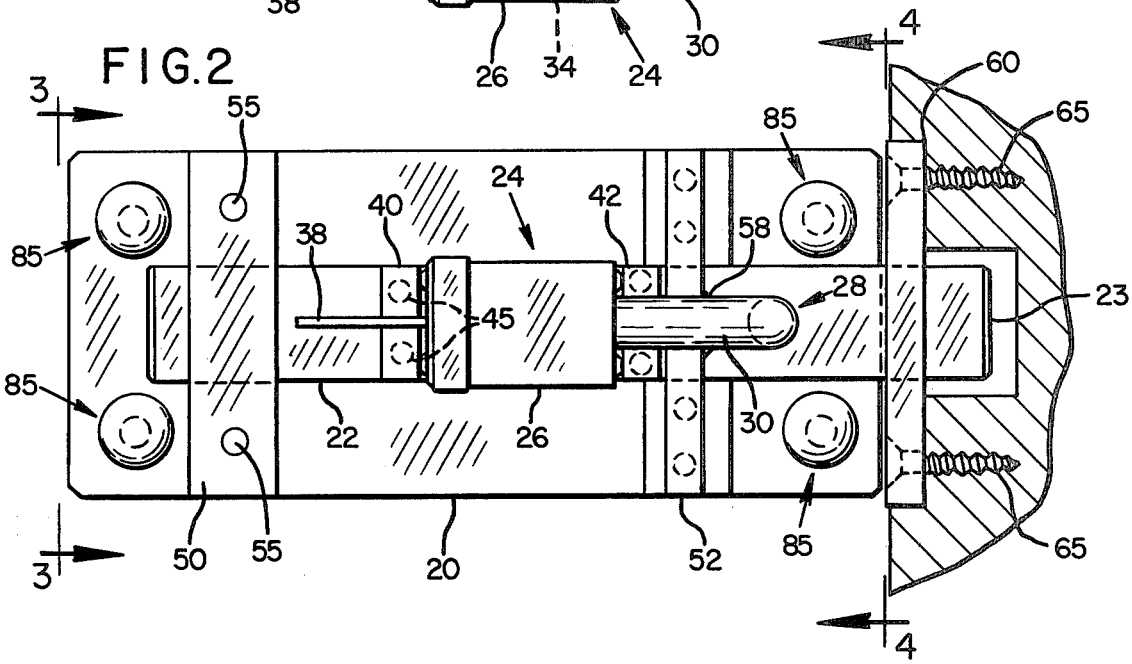
FIG. 3
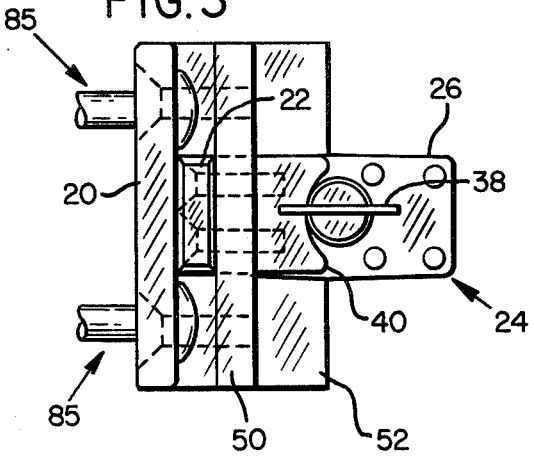
FIG. 4
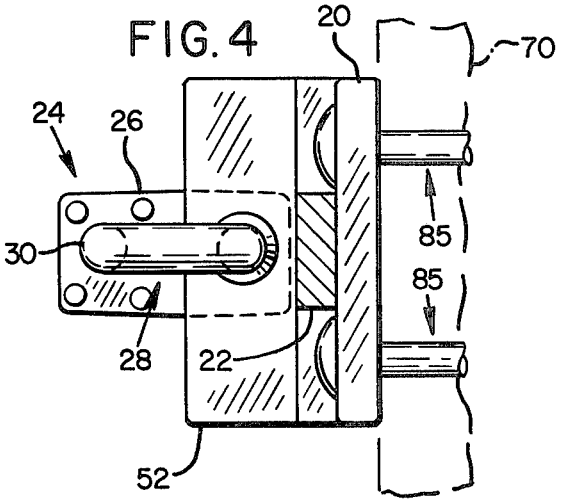

20
85
70
60
62
23
A
B
22
58
50
40
42
32
52
28
38
30
26
24
C
8
34
36

PADLOCK AND BOLT ASSEMBLY

BACKGROUND OF THE INVENTION

This invention relates to a combination padlock and bolt assemby which provides an exceptionally high degree of security in that unauthorized opening thereof can only be accomplished by severance of both legs of the U-shaped link of the padlock.

The problem with most locking systems utilizing padlocks as the locking mechanism is that unauthorized access may be had by simply cutting the U-shaped link of the padlock in a single place, which significantly detracts from the security offered by the locking system since at least a portion of the link is usually well exposed. Since a single cut of the padlock link is the normal mode utilized by thieves and burglars in gaining access to padlocked items and premises, the provision of a locking system based upon a padlock wherein both legs of the U-shaped padlock link must be cut or otherwise severed in order to gain access, and wherein at least one leg of the link is protected and relatively inaccessible, will offer significantly increased security over conventional locking systems utilizing padlocks.

SUMMARY OF THE INVENTION

The present invention is directed to a high-security padlock and bolt assembly. More particularly, the padlock and bolt assembly is one wherein the bolt has an intermediate stop position between full engagement and full disengagement, which intermediate position can only be cleared by normal operation of the padlock with its key or by a severing of both legs of the generally U-shaped link of the padlock.

Such assembly comprises a slideable bolt which may be selectively engaged or disengaged with a separate bolt receiving member; a padlock, typically comprising a barrel and a generally U-shaped link having a first leg slideably disengageable from the barrel and a second leg pivotally and slideably secured to the barrel; and interconnecting means which connects the bolt with the padlock in such a manner as to allow the bolt to be only partially withdrawn from the bolt receiving member (the intermediate position) upon disengagement of the first leg of the padlock link from the padlock barrel, and completely withdrawn only upon normal opening of the padlock with its key and pivoting of the barrel relative to the second leg of the link, or upon severance of the second leg of the link.

The interconnecting means accomplishes the foregoing functions by means of a novel structure which interacts with two features common to most conventional padlocks: (1) relative pivotal movement between the barrel and the second leg of the link and (2) a limiting mechanism preventing total disengagement of the second leg of the link from the barrel.

In the preferred embodiment, the interconnecting means comprises a bracket secured to the link and a pair of yoke members secured to the bolt for straddling the barrel, with one of the yoke members slideably engaging the first leg of the link. The yoke members cooperate with the limiting mechanism of the padlock to prevent withdrawal of the bolt beyond the intermediate position even though the first leg of the link is disengaged from the barrel. However, the yoke members are oriented with respect to the barrel so as to permit the barrel thereafter to be pivoted about the second leg of the link, which is pivotally and slideably secured to the barrel, from a position straddled by the yoke members to a position not straddled by the yoke members when the barrel is unlocked from the first leg of the link, thereby permitting the bolt to be fully withdrawn. This double stop feature provided by the interconnecting means can be utilized to increase the security afforded by the padlock and bolt assembly by so positioning the assembly on the jamb, door, or other openable portion of the item to be secured as to make clearance of both stops of the bolt a prerequisite to access to the padlocked item or premises.

BRIEF DESCRIPTION OF THE DRAWINGS

FIG. 1 is a plan view of the preferred embodiment of the padlock and bolt assembly of the present invention shown in a typical installation on a door.

FIG. 2 is a front view of the preferred embodiment of the padlock and bolt assembly of FIG. 1.

FIG. 3 is an end view taken along line 3—3 of FIG. 2.

FIG. 4 is an end view taken along line 4—4 of FIG. 2.

DESCRIPTION OF THE PREFERRED EMBODIMENT

Figures 5, 6, 7, 8, 9:
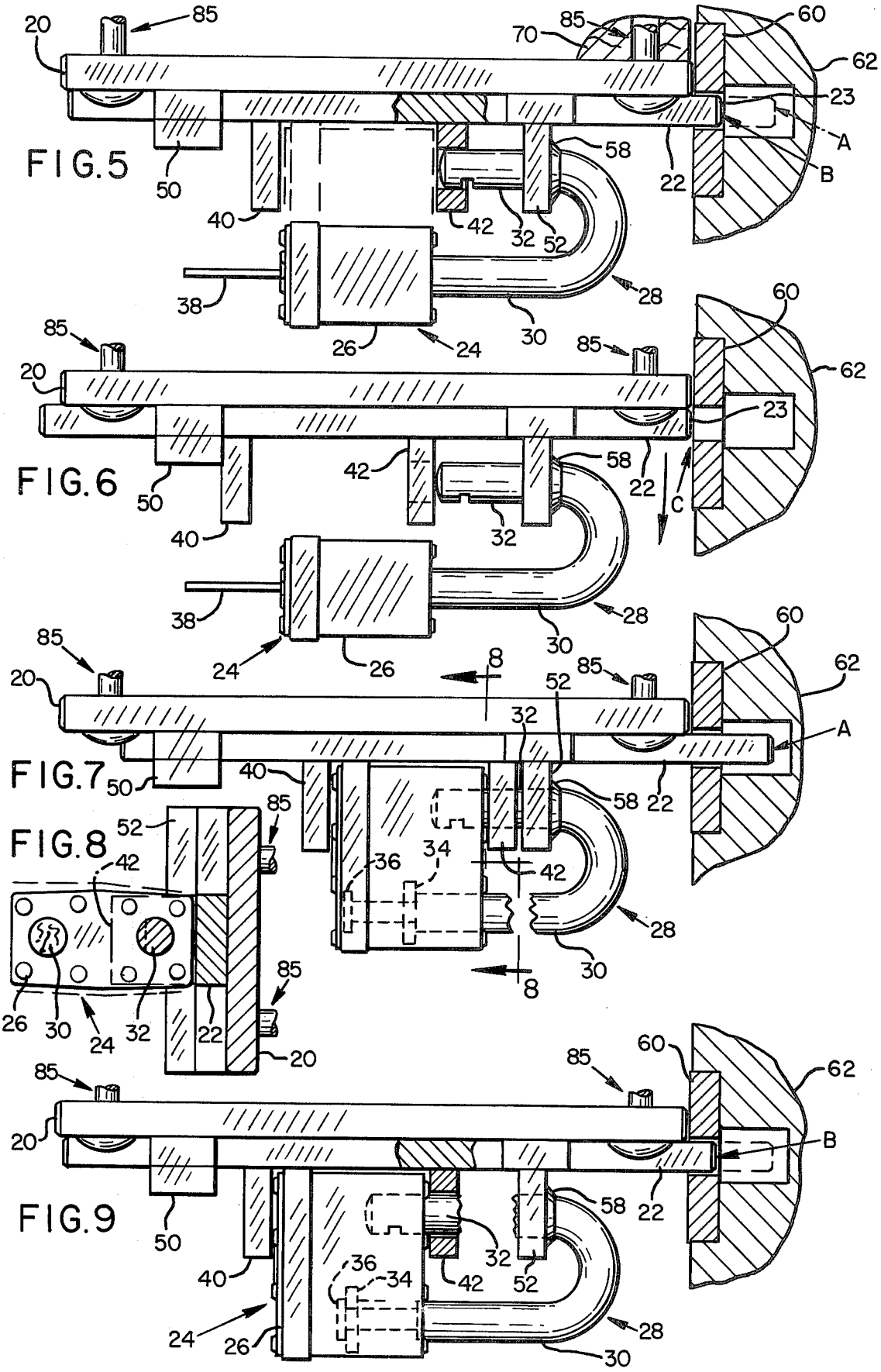
FIGS. 5–6 are plan views of the preferred embodiment of the padlock and bolt assembly of the present invention showing normal sequenced operation thereof.
FIGS. 7 and 9 are plan views of the preferred embodiment showing operation thereof under abnormal conditions of unauthorized tampering.
FIG. 8 is a partial sectional view of the preferred embodiment taken along line 8—8 of FIG. 7.

Referring to FIGS. 1–4 of the drawings, the preferred embodiment of the padlock and bolt assembly of the present invention is seen to include a base plate 20, a slideable bolt 22, and a padlock 24 having a barrel 26 and a generally U-shaped link 28 having legs 30 and 32, leg 30 being pivotally and slideably secured to barrel 26 by limiting means such as an internal annular collar 34 operating in conjunction with a stop 36, and leg 32 being slideably disengageable from barrel 26 by normal operation of the padlock with its key 38.

Although the limiting means of the padlock has been illustrated as an internal annular collar 34 operating in conjunction with a stop 36, any limiting means employed in a padlock would work equally well so long as its function included prevention of total disengagement of one pivotal leg of a generally U-shaped link from the barrel of the padlock.

The padlock barrel 26 is straddled by a pair of yoke members 40 and 42 secured to bolt 22 by means such as screws 45, it being understood that the yoke members 40 and 42 may be integral with the bolt 22. One such yoke member 42 has an aperture therethrough which receives leg 32.

Slideable mounting of the bolt 22 on base plate 20 may be accomplished by means such as sleeve brackets 50 and 52, which in turn are secured to base plate 20 by means such as screws 55, it being understood that sleeve brackets 50 and 52 may be integral with base plate 20.

One sleeve bracket 52 is T-shaped in cross-section and is secured to the U-shaped link 28 of the padlock 24 by a weld 58. Although the T-shaped sleeve bracket 52 is shown as being secured to leg 32 of the link 28, it would suffice as well to secure it to either or both of legs 30 or 32, or to the portion of the U-shaped link 28 which interconnects the two legs, or to any combination of the three portions of the link.

A bolt receiving means exemplified in FIG. 1 as a catch plate 60 mounted to, for example, a door jam 62 by screws 65 may be used in conjunction with the padlock and bolt assembly of the present invention. The bolt receiving means could of course be nothing more than a recess in a door jamb or the like, and is intended broadly to include any suitable means for selectively engaging or disengaging the end of the bolt in response to the sliding movement thereof, such as for example a door jamb wherein the bolt and padlock assembly is mounted on the inside of an outwardly opening door with the bolt abutting the jamb.

It should also be understood that the padlock and bolt assembly of the present invention may be mounted on the jamb, as opposed to a door or the like, in which case the bolt receiving means, would be in or mounted upon the door or other openable portion of the item to be locked.

Base plate 20 may be mounted to a door 70 or other surface by any suitable means such as that shown by anchor plate 80 secured by nut and bolt assembly 85, the nuts being interior to the door and the bolts having smooth heads to prevent tampering.

In operation, when the padlock 24 is locked as shown in FIGS. 1 and 2, the bolt 22 is at a fully extended, fully engaged position (also indicated generally by the broken lines at A in FIG. 5). Upon normal unlocking of the padlock 24 with its key 38, leg 32 of link 28 disengages from the barrel 26 and bolt 22 is free to slide to a first, partially withdrawn position indicated generally at B in FIG. 5, exemplified by the bolt face 23 being within and not clear of catch plate 60.

Further withdrawal of the bolt is prevented by the abutment of yoke member 42 with the padlock barrel 26, the barrel 26 being prevented from further withdrawal by the engagement of stop 36 with annular collar 34 within the barrel. However, upon disengagement of leg 32 of link 28 from barrel 26, barrel 26 is free to pivot about the axis of leg 30 so as to swing free from yoke members 40 and 42, as shown in FIG. 5. Once barrel 26 has cleared yoke members 40 and 42, bolt 22 is free to be withdrawn to a second position exemplified generally in FIG. 6 at C wherein bolt face 23 is clear of catch plate 60.

FIGS. 7–9 demonstrate the security offered by the padlock and bolt assembly of the present invention when one leg only of the U-shaped link is cut. In FIGS. 7 and 8, the exposed leg 30 of the padlock link 28 is shown severed. Since leg 32 of the link is still engaged with the barrel 26, slideable withdrawal of barrel 26 is impossible, which in turn prevents lateral movement of yoke member 42 thereby rendering impossible slideable withdrawal of bolt 22 from the fully engaged position A shown in FIG. 7. FIG. 8 demonstrates that barrel 26 of the padlock is not rotatable about leg 32 when leg 30 is severed.

FIG. 9 demonstrates the security offered when the other leg 32 of the padlock link 28 is severed. It will be noted that severance of the leg 32 will be much more difficult than severance of leg 30 because of the protection afforded by yoke member 42. The close fit of the yoke members 40 and 42 with respect to the barrel 26 makes it impossible to sever the leg 32 except (possibly by means of a saw blade) at a location between the yoke member 42 and sleeve bracket 52. Severance of leg 32 at this point allows slideable withdrawal of barrel 26 along the axis of leg 30 to the limit imposed upon stop 36 of leg 30 by annular collar 34, thereby permitting withdrawal of bolt 22 to the intermediate position B shown in FIG. 9 which is still not clear of catch plate 60. Since a portion of leg 32 is still engaged with both barrel 26 and yoke member 42, barrel 26 is not free to pivot about leg 30 and thus may not swing free of yoke members 40 and 42. This is turn prevents complete withdrawal of bolt 22 to the fully disengaged position exemplified generally by C in FIG. 6.

Thus, bolt 22 can clear the intermediate stop position shown generally as B in FIGS. 5 and 9 only upon normal operation of the padlock with its key or by severance of both legs 30 and 32 of the padlock link 28.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follows.

What is claimed is:

1. A padlock and bolt assembly comprising:
(a) a base plate;
(b) a bolt slideably mounted on said base plate;
(c) a padlock comprising a barrel and a generally U-shaped link having first and second legs, the first leg of said link being slideably disengageable from said barrel and the second leg of said link being pivotally and slideably secured to said barrel;
(d) sleeve bracket means secured to said base plate for slideably receiving said bolt, said sleeve bracket means being secured also to said link; and
(e) a pair of padlock yoke members secured to said bolt for straddling said barrel, one of said yoke members slideably engaging the first leg of said link, said yoke members being oriented with respect to said barrel so as to permit said barrel to be pivoted about said second leg of said link from a position straddled by said yoke members to a position not straddled by said yoke members when said barrel is disengaged from said first leg of said link.

2. A padlock and bolt assembly comprising:
(a) a base plate;
(b) a bolt slidably mounted on said base plate so as to slide in a predetermined sliding direction with respect to said base plate;
(c) a padlock comprising a barrel and a generally U-shaped link having first and second legs, the first leg of said link being slidably disengagable from said barrel and the second leg of said link being pivotally and slidably secured to said barrel, said barrel including limiting means for preventing the sliding disengagement of said second leg from said barrel;
(d) means mounting said link with respect to said bolt in a position wherein the longitudinal axes said legs of said link extend in said predetermined sliding direction; and
(e) means interconnecting said bolt with said barrel for permitting partial slidable withdrawal of said bolt, simultaneously with the slidable disengagement of said first leg of said link from said barrel, to a first position wherein said limiting means impedes further withdrawal of said bolt, and for permitting further slidable withdrawal of said bolt to a second position in response to the pivoting of said barrel relative to said second leg of said link.

3. The padlock and bolt assembly of claim 2 wherein said means mounting said link with respect to said bolt comprises means fixedly securing said link to said base plate for holding said link with respect to said base plate during sliding movement of said bolt.

4. A padlock and bolt assembly comprising:

(a) a base plate;

(b) a bolt slidably mounted on said base plate so as to slide in a predetermined sliding direction with respect to said base plate;

(c) a padlock comprising a barrel and a generally U-shaped link having first and second legs, the first leg of said link being slidably disengageable from said barrel and the second leg of said link being pivotally and slidably secured to said barrel, said barrel including limiting means for preventing the sliding disengagement of said second leg from said barrel;

(d) means fixedly securing said link to said base plate in a position wherein the longitudinal axes of said legs of said link extend in said predetermined sliding direction; and (e) means interconnecting said bolt with said barrel of said padlock for permitting partial slidable withdrawal of said bolt to a first position, in response to the disengagement of said first leg of said link from said barrel, wherein said limiting means impedes further withdrawal of said bolt, and for permitting further slidable withdrawal of said bolt to a second position in response to the pivoting of said barrel relative to said second leg of said link.

* * * * *